US012559285B2

(12) United States Patent
Hayes et al.

(10) Patent No.: US 12,559,285 B2
(45) Date of Patent: Feb. 24, 2026

(54) PACKAGING WITH INTEGRATED CUSHIONING SUPPORTS

(71) Applicant: Apple Inc., Cupertino, CA (US)

(72) Inventors: Isaac Hayes, Austin, TX (US); Bartley K. Andre, Palo Alto, CA (US); Yi-Tung Shen, San Jose, CA (US); Jonathan Gomez Garcia, San Francisco, CA (US); Michael S. Long, Fremont, CA (US); Kevin T. Pagano, San Francisco, CA (US); Anne-Marie Heck, San Francisco, CA (US); Avianne Marie Bracamonte Tuano, San Jose, CA (US); John Alpine, Broomfield, CO (US); David Michel Provoost, Oudenaarde (BE); Herman Germain De Dycker, Wichelen (BE)

(73) Assignee: Apple Inc., Cupertino, CA (US)

( * ) Notice: Subject to any disclaimer, the term of this patent is extended or adjusted under 35 U.S.C. 154(b) by 131 days.

(21) Appl. No.: 18/512,760

(22) Filed: Nov. 17, 2023

(65) Prior Publication Data

US 2024/0190607 A1 Jun. 13, 2024

Related U.S. Application Data

(60) Provisional application No. 63/387,012, filed on Dec. 12, 2022.

(51) Int. Cl.
*B65D 5/50* (2006.01)
*B65D 5/20* (2006.01)
(Continued)

(52) U.S. Cl.
CPC ..... *B65D 5/5021* (2013.01); *B65D 5/2009* (2013.01); *B65D 5/4266* (2013.01); *B65D 5/545* (2013.01); *B65D 2543/00851* (2013.01)

(58) Field of Classification Search
CPC .. B65D 5/5069; B65D 5/5028; B65D 5/5035; B65D 5/5021; B65D 5/2009; B65D 5/00;
(Continued)

(56) References Cited

U.S. PATENT DOCUMENTS 1,585,684 A * 5/1926 Oppenheim ..... B65D 5/5069 206/521
2,132,957 A * 10/1938 Mahone ..... B65D 5/2004 229/122.34

(Continued)

FOREIGN PATENT DOCUMENTS

| | | | |
|---|---|---|---|
| EP | 0553711 | A1 | 8/1993 |
| JP | S50138327 | U | 11/1975 |
| WO | 2021070133 | A1 | 4/2021 |

*Primary Examiner* — Steven A. Reynolds
*Assistant Examiner* — Prince Pal
(74) *Attorney, Agent, or Firm* — Sterne, Kessler, Goldstein & Fox P.L.L.C.

(57) ABSTRACT

A product packaging is disclosed. The product packaging includes a base box and a cover. The base box includes a base panel and cushioning cells together defining a product-receiving space. The cushioning cells include an upper cushioning cell disposed at an upper edge of the base panel, a lower cushioning cell disposed at a lower edge of the base panel, a left side cushioning cell disposed at a left side edge of the base panel, and a right side cushioning cell disposed at a right side edge of the base panel. The cover covers the product-receiving space and is coupled to the left side cushioning cell and to the right side cushioning cell. The left side cushioning cell and the right side cushioning cell are hingedly coupled to the base panel. The base panel and the cushioning cells are integral and formed from a single blank.

19 Claims, 10 Drawing Sheets

(51) Int. Cl.
*B65D 5/42* (2006.01)
*B65D 5/54* (2006.01)

(58) Field of Classification Search
CPC ..... B65D 5/66; B65D 5/4266; B65D 5/542; B65D 2543/00851
USPC ..... 206/521, 586, 588, 45.23, 485, 464
See application file for complete search history.

(56) References Cited

U.S. PATENT DOCUMENTS 2,148,048 A * 2/1939 Gray ..... B65D 5/2009 47/84
2,283,950 A * 5/1942 Ringler ..... B65D 5/22 229/176
2,345,716 A * 4/1944 Smith ..... B65D 5/2009 229/167
2,451,209 A * 10/1948 Frankenstein ..... B65D 5/2009 229/167
2,465,169 A * 3/1949 O'Connor ..... B65D 5/5021 229/173
2,535,056 A * 12/1950 Frankenstein ..... B65D 5/2009 229/176
2,588,377 A * 3/1952 Frankenstein ..... B65D 5/248 206/45.21
2,687,839 A * 8/1954 Gray ..... B65D 5/2009 229/176
2,705,589 A * 4/1955 Steele ..... B65D 5/2009 229/113
2,768,737 A * 10/1956 Callahan ..... B65D 85/42 206/418
2,774,530 A * 12/1956 Bolding ..... B65D 5/2009 229/176
2,808,978 A * 10/1957 Wright ..... B65D 5/5071 206/320
2,851,208 A * 9/1958 Samsing ..... B65D 5/324 40/788
2,893,622 A * 7/1959 Fogel ..... B65D 5/2009 229/162.1
2,925,211 A * 2/1960 Frankenstein ..... B65D 5/2009 229/176
3,043,488 A * 7/1962 Warwick ..... B65D 85/48 206/448
3,121,525 A * 2/1964 Hayes ..... B65D 5/2009 206/424
3,539,094 A * 11/1970 Collura ..... B65D 5/2009 229/178
3,596,830 A * 8/1971 McFarland ..... B65D 5/5038 206/592
3,695,421 A * 10/1972 Wood ..... B65D 81/057 217/53
3,713,577 A * 1/1973 Skinner ..... B65D 5/2009 206/424
3,744,706 A * 7/1973 Colantoni ..... B65D 5/2009 229/162.1
3,765,598 A * 10/1973 Rosenburg, Jr. ..... B65D 5/2009 229/168
3,790,065 A * 2/1974 Carpenter ..... B65D 5/0245 206/424
3,791,571 A * 2/1974 Pilz, III ..... B65D 5/0245 206/424
3,949,868 A * 4/1976 Allen ..... B65D 5/4204 206/777
4,134,497 A * 1/1979 Dlugopolski ..... B65D 5/5038 206/521
4,146,127 A * 3/1979 Bayer ..... B65D 85/187 206/294
4,170,297 A * 10/1979 Johnson ..... B65D 85/62 206/326
4,413,726 A * 11/1983 Davidson ..... B65D 5/4241 229/172
4,415,078 A * 11/1983 Hart ..... B65D 5/5016 206/781
4,615,461 A * 10/1986 Liu ..... H05K 13/0084 220/815
5,251,760 A * 10/1993 Smith ..... B65D 5/5028 206/583
5,467,875 A * 11/1995 Sato ..... B65D 5/5071 206/588
5,522,539 A * 6/1996 Bazany ..... B65D 5/5088 229/199
5,532,044 A * 7/1996 Jen ..... B65D 5/5035 428/167
5,803,267 A * 9/1998 Tu ..... B65D 5/5021 206/723
5,823,352 A * 10/1998 Mena ..... B65D 5/4204 206/721
5,871,147 A * 2/1999 Smith ..... B65D 5/5016 229/120.17
6,095,408 A * 8/2000 Nguyen ..... B65D 5/5021 229/150
6,257,412 B1 * 7/2001 Yamamoto ..... B65D 5/5071 206/320
6,268,039 B1 * 7/2001 Chou ..... B65D 5/5069 206/583
6,308,828 B1 * 10/2001 Jones ..... B65D 77/003 206/583
6,685,025 B1 * 2/2004 Kari ..... B65D 5/5069 206/583
6,685,026 B1 * 2/2004 Hanna ..... B65D 5/5021 206/592
6,758,340 B1 * 7/2004 Feibelman ..... B65D 5/4204 206/775
6,769,547 B2 * 8/2004 Yu ..... B65D 81/113 206/592
6,789,675 B2 * 9/2004 Abe ..... B65D 77/26 206/521
6,997,323 B2 * 2/2006 Maresh ..... B65D 5/5069 206/592
7,021,024 B2 * 4/2006 Kari ..... B65D 5/5069 493/137
7,080,772 B2 * 7/2006 Lebras ..... B65D 81/264 229/122.34
7,097,042 B2 * 8/2006 Hsu ..... B65D 5/4801 229/120.04
7,293,695 B2 * 11/2007 Stier ..... B65D 5/4802 229/160
7,344,029 B2 * 3/2008 Sattora ..... B65D 5/5035 206/592
7,494,013 B2 * 2/2009 Kao ..... B65D 5/5069 206/592
7,604,119 B2 * 10/2009 Schott ..... B65D 5/5021 206/454
7,866,479 B2 * 1/2011 Fan ..... B65D 81/058 206/592
9,725,230 B2 * 8/2017 Huang ..... B65D 59/04
D819,128 S * 5/2018 Sowder ..... D19/113
10,293,634 B2 * 5/2019 Sowder ..... B44D 3/18
10,301,046 B2 * 5/2019 Mundt ..... B65D 5/6676
11,267,636 B2 * 3/2022 Henigman ..... B65D 65/466
11,414,247 B1 * 8/2022 Philips ..... B65D 43/24
12,012,268 B2 * 6/2024 Uyeda ..... B65D 5/5021
12,263,999 B2 * 4/2025 Henigman ..... A45D 40/00
2001/0040113 A1 * 11/2001 Wong ..... B65D 5/504 206/521
2002/0148744 A1 * 10/2002 Hsu ..... B65D 5/5052 206/320
2003/0178338 A1 * 9/2003 Vore ..... B65D 5/5042 206/521
2003/0205498 A1 * 11/2003 Maresh ..... B65D 5/5069 206/592
2004/0206657 A1 * 10/2004 Yokawa ..... B65D 5/5035 206/523
2005/0023162 A1 * 2/2005 Hsu ..... B65D 5/48018 206/521
2005/0155890 A1 * 7/2005 Manuel ..... B65D 81/113 206/521
2005/0173288 A1 * 8/2005 Chiang ..... H03H 9/1021 206/521

(56) References Cited

U.S. PATENT DOCUMENTS

2005/0211600 A1* 9/2005 Saito ..... B65D 5/0227 206/521
2006/0021902 A1* 2/2006 Chen ..... B65D 81/02 206/586
2006/0086630 A1* 4/2006 Cheong ..... B65D 5/5021 206/307
2006/0086635 A1* 4/2006 Kari ..... B65D 5/5052 206/588
2006/0131198 A1* 6/2006 Schott ..... B65D 5/5021 206/454
2006/0289332 A1* 12/2006 Hsieh ..... B65D 81/057 206/521
2007/0051659 A1* 3/2007 Sattora ..... B65D 5/5035 206/586
2007/0199837 A1* 8/2007 Justice ..... B65D 85/62 206/215
2007/0215509 A1* 9/2007 Moses ..... G11B 23/0236 206/485
2007/0251856 A1* 11/2007 Zietlow ..... B65D 5/503 206/586
2007/0251985 A1* 11/2007 Boase ..... B65D 5/2009 229/167
2008/0067106 A1* 3/2008 Kuo ..... B65D 81/055 206/588
2008/0179216 A1* 7/2008 Kari ..... B65D 81/057 206/586
2008/0223910 A1* 9/2008 Maruno ..... B65D 5/5052 229/121
2008/0237070 A1* 10/2008 Justice ..... B65D 5/4604 206/215
2009/0173659 A1* 7/2009 Li ..... B65D 5/5004 206/588
2009/0314826 A1* 12/2009 Lee ..... B65B 23/00 53/472
2010/0116706 A1* 5/2010 Goretti ..... B65D 5/6605 206/521
2010/0187149 A1* 7/2010 Tsukii ..... B65D 5/5035 493/405
2011/0132799 A1* 6/2011 Lee ..... B65D 81/054 206/586
2011/0233098 A1* 9/2011 Ye ..... B65D 5/5009 206/521
2012/0043249 A1* 2/2012 Tsukii ..... B65D 81/05 206/521
2013/0048533 A1* 2/2013 McDonald ..... B65D 5/5021 206/591
2013/0277418 A1* 10/2013 Van Berlo ..... B65D 81/02 229/87.02
2016/0101922 A1* 4/2016 Costanzo, Jr. ..... B65D 5/4266 206/583
2016/0297236 A1* 10/2016 Edgerton-Ball ..... A47G 1/0605
2018/0009586 A1* 1/2018 Mundt ..... B65B 5/04
2018/0050558 A1* 2/2018 Sowder ..... B44D 3/18
2018/0251257 A1* 9/2018 Hasegawa ..... B65D 5/46024
2019/0352044 A1* 11/2019 Johnston ..... B65D 5/4237
2020/0002048 A1* 1/2020 Shaffer ..... B65D 5/4266
2022/0315303 A1* 10/2022 Uyeda ..... B65D 5/5021
2022/0411149 A1* 12/2022 Kumka ..... B65D 5/38
2023/0079525 A1* 3/2023 Tuano ..... B65D 5/2009 229/128
2023/0093285 A1* 3/2023 Lee ..... B65D 5/6626 229/109
2023/0202730 A1* 6/2023 Comerford ..... B65D 81/07 206/521
2023/0264883 A1* 8/2023 Nemoto ..... B65D 81/057 206/586
2024/0083654 A1* 3/2024 Comerford ..... B65D 5/5035
2024/0182202 A1* 6/2024 Kim ..... B31B 50/262
2024/0190607 A1* 6/2024 Hayes ..... B65D 5/4266
2024/0409266 A1* 12/2024 Sollie ..... B65D 5/3621

* cited by examiner

PACKAGING WITH INTEGRATED CUSHIONING SUPPORTS

CROSS-REFERENCE TO RELATED APPLICATION(S)

This application claims the benefit of U.S. Provisional Patent Application No. 63/387,012, titled "PACKAGING WITH INTEGRATED CUSHIONING SUPPORTS" filed on Dec. 12, 2022, the disclosure of which is incorporated by reference herein in its entirety.

FIELD

The described embodiments relate generally to packaging. More specifically, the present embodiments relate to packaging with integrated cushioning supports capable of providing contiguous support to a product inside the packaging.

BACKGROUND

Product packaging is used to store, transport, protect and/or present products to consumers or end users. For instance, shipping packaging is used to transport or ship a finished goods package containing a product. It is important to provide adequate protection to the product to the destination while maintaining the presentation of the product to the consumer or the end user.

Certain current packaging may use, e.g., a polymeric film to retain the finished goods package. Other shipping packaging may use expanded polystyrene cushions, or other less environmentally friendly cushioning systems (e.g., plastic bubble pack materials). These packaging systems can require different configurations for differently sized products, and therefore, existing shipping packaging systems may use separately designed and/or sized cushioning systems for shipping items.

Accordingly, there exists a need for a new and improved packaging system that can maintain packaging integrity and cushioning characteristics prior to being received by an end user, with high recyclability of the packaging while maintaining the flexibility of the supply chain by allowing various products or finished goods packaging to be received in a shipping packaging. Further, there is a need for a packaging system to promote simple and efficient handling for a shipper and easy and simple unboxing for an end user for easy opening and access to the product inside.

SUMMARY

Some embodiments are directed to product packaging having a base box and a cover. The base box includes a base panel and cushioning cells. The cushioning cells include an upper cushioning cell disposed at an upper edge of the base panel and defining an upper side of the base box, a lower cushioning cell disposed at a lower edge of the base panel and defining a lower side of the base box, a left side cushioning cell disposed at a left side edge of the base panel and defining a left side of the base box, and a right side cushioning cell disposed at a right side edge of the base panel and defining a right side of the base box. The base panel and the cushioning cells together define a product-receiving space, and the base panel and the cushioning cells are integral and formed from a single blank. The cover is configured to cover the product-receiving space of the base box, and coupled to the left side cushioning cell and to the right side cushioning cell. The left side cushioning cell and the right side cushioning cell are hingedly coupled to the base panel.

In some embodiments, when the cover is intact and is coupled to the left side cushioning cell and the right side cushioning cell, the cover stops the left side cushioning cell and the right side cushioning cell from rotating relative to the base panel, and maintains the product packaging in a closed configuration. The cover is configured to be separated into a left cover panel coupled to the left side cushioning cell and a right cover panel coupled to the right side cushioning cell such that separating the cover into the left cover panel and the right cover panel transitions the packaging into an open configuration in which the left side cushioning cell and the right side cushioning cell rotate together with the left cover panel and the right cover panel, respectively, relative to the base panel to expose and expand the product-receiving space.

In some embodiments, the cover panel includes a ripcord extending between the left cover panel and the right cover panel. The left cover panel, the right cover panel, and the ripcord are integral and formed from a single blank. Tearing away the ripcord separates the left cover panel and the right cover panel, thereby allowing the left cover panel and the right cover panel to be rotated away from each other and exposing the product-receiving space. The left cover panel includes a left front cover panel and a left side cover panel, and the left side cover panel is adhered to an outer side of the left side cushioning cell. The right cover panel includes a right front cover panel and a right side cover panel, and the right side cover panel is adhered to an outer side of the right-side cushioning cell. When the left cover panel and the right cover panel are separated and rotated away from each other, the left side cover panel and the right side cover panel rotate together with the left side cushioning cell and the right side cushioning cell, respectively, to expand the product-receiving space.

In some embodiments, each of the cushioning cells includes four panels arranged to form a rectangular cross-section. Each of the left side cushioning cell and the right side cushioning cell further includes a fifth panel, the fifth panel being adhered to one of the four panels. In some embodiments, none of the panels of the left side cushioning cell or the right side cushioning cell are adhered to the base panel. Each of the upper and lower cushioning cells includes a fifth panel, the fifth panel forming a hypotenuse panel extending diagonally between interior corners of its respective cushioning cell.

In some embodiments, the hypotenuse panels extend upwardly toward the product-receiving space. Each hypotenuse panel has a length less than those of the other four panels of its respective cushioning cell. An adhesive is disposed on an outer side of a panel adjacent to the hypotenuse panel of the panels of each of the upper and lower cushioning cells, adhering its respective cushioning cell to the base panel.

Some embodiments are directed to a packaged product assembly having the product packaging and a product disposed within the product-receiving space. The product packaging is in a closed configuration in which the product is restrained from moving relative to the product packaging by contact with the base panel, the cushioning cells, and the cover.

In some embodiments, the product is a packaged product including retail packaging having an outer shape of a rectangular cuboid. The base panel, the cushioning cells, and the cover together define the product-receiving space as a rectangular cuboid matching that of the outer shape of the retail packaging, such that the retail packaging secured in the produce-receiving space.

Some embodiments are directed to a blank for forming product packaging. The blank includes a central base panel, a left panel, a right panel, an upper panel, and a lower panel. The left panel integrally extends outward from a left side of the central base panel and connected to the central base panel at an upward fold line. The right panel integrally extends outward from a right side of the central base panel and connected to the central base panel at an upward fold line. An upper panel integrally extends outward from an upper side of the central base panel and connected to the central base panel at an upward fold line. The lower panel integrally extends outward from a lower side of the central base panel and connected to the central base panel at an upward fold line. Each of the left panel and the right panel includes five sub-panels connected at parallel upward fold lines, and counting outward from the central base panel, their first and third sub-panels all have the same width, and their second and fourth sub-panels all have the same width. Each of the upper panel and the lower panel includes five sub-panels connected at parallel upward fold lines, and counting outward from the central base panel, their first and third sub-panels all have the same height, their second and fourth sub-panels all have the same height and their fifth sub-panels both have a height equal to a hypotenuse height, where the square of the hypotenuse height equals the sum of the squares of the heights of the third sub-panels and the fourth sub-panels. Each of the left panel, the right panel, the upper panel, and the lower panel is configured to be folded to form a cushioning cell disposed around a perimeter of the central base panel, thereby forming a base box.

Some embodiments are directed to a blank system that includes the blank and a cover blank. The blank is a base box blank, and the cover blank includes a central cover panel. The central cover panel has a width equal to a width of the central base panel. The central cover panel includes a ripcord extending vertically along its entire height, and the ripcord is disposed centrally along the width of the central cover panel.

In some embodiments, the cover blank includes: a left side panel integrally extending outward from a left side of the central cover panel and connected to the central cover panel at a downward fold line, and a right side panel integrally extending outward from a right side of the central cover panel and connected to the central cover panel at a downward fold line. The left side panel and the right side panel each has the same width as the width of the first sub-panels of the left panel and the right panel the base box blank.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
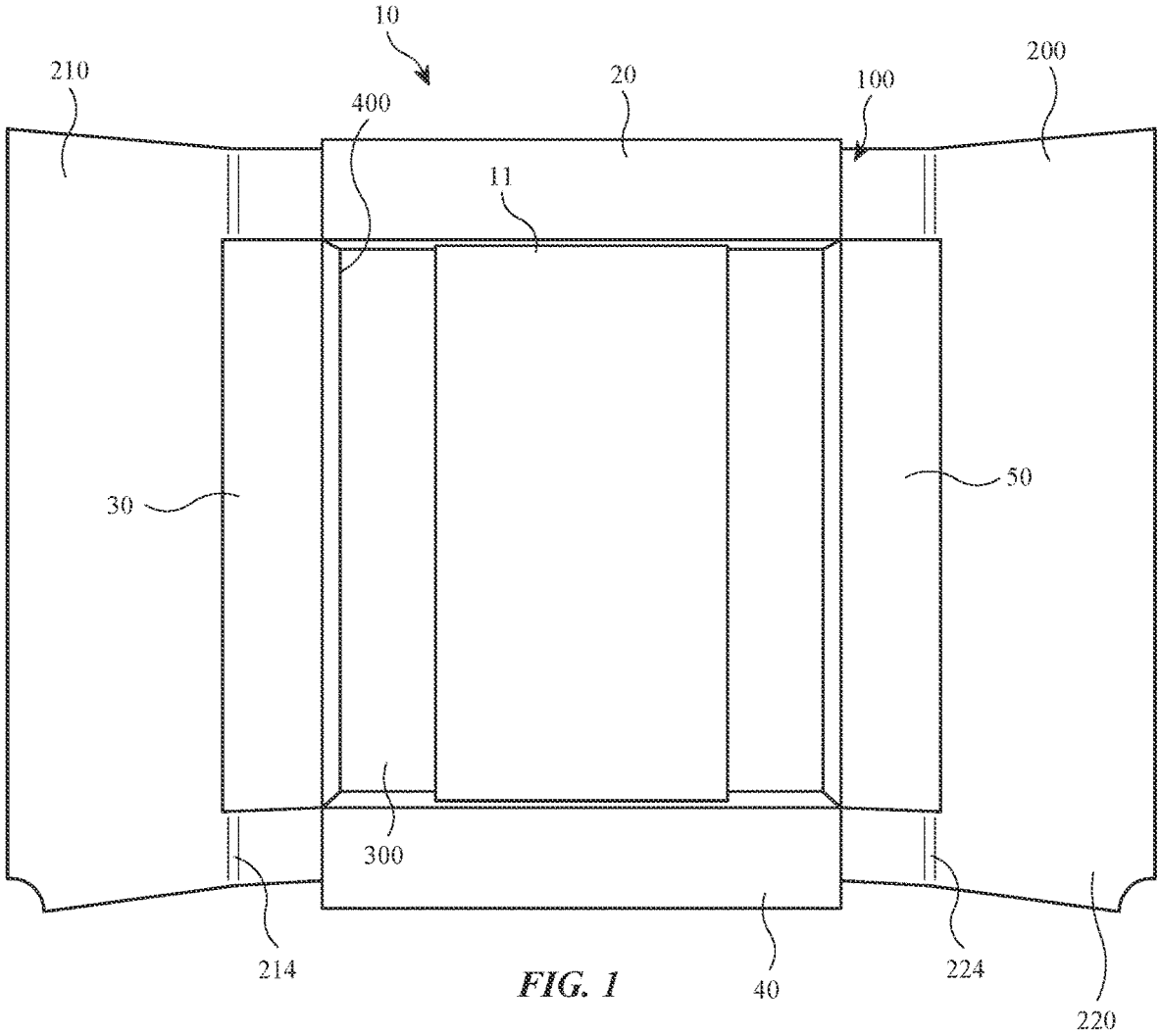
FIG. 1 shows a product packaging in an open configuration according to some embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a packaging system that reduces packaging materials and packaging processes while facilitating an end user unboxing and still providing a tamper-evident apparatus. In some existing packaging systems, shipping boxes are provided in flat blanks and assembled by a shipper, and separately provided cushioning materials are placed in the assembled boxes to protect products and minimize their movement within the shipping boxes. There is a burden for shippers to use adequate amount and/or size of the cushioning materials for each packaging to ensure adequate packaging protection, which can complicate assembly processes. Further, shippers may use separately provided tapes or the like to seal shipping boxes. Challenges in such packaging systems include securing a product in its originally packaged condition without damage to the product and its packaging, providing a tamper-evident seal, reducing the burden to the shipper and packaging manufacturer, and providing an easy user experience for opening the packaging and accessing the packaged product by the end user.

The packaging described herein relates to a product packaging providing a packaging solution utilizing environmentally friendly materials, and providing an improved cushioning system. Some embodiments include packaging including a base box with enhanced cushioning configurations integrated therein to surround a product, and a cover securely covering the packaging with a tamper-evident seal. Elements are described that achieve a structurally sound package, while allowing for easy manufacturing, assembly, and packing of the packaging, providing sufficient cushioning and support during transport, and providing for an improved opening experience.

Such product packaging may include two integral components: a base box integrally incorporating cushioning cells, and a cover. In some embodiments both the base box and the cover are formed of a unitary cardboard material, e.g., paperboard or cardboard corrugate, or any other environmentally friendly recyclable materials. In particular, the base box including the cushioning system may be formed from a continuous sheet (e.g., a cardboard blank), with the cushioning system provided formed from the perimeter portion thereof. The cover may similarly be formed from a continuous sheet. The base box and cover may be formed of the same material or different materials that are recyclable in the same fiber-recycling stream. Advantageously, this improves upon prior systems having, for example, plastic film retention elements.

In some embodiments, packaging that is constructed by assembling two parts (e.g., base box and cover) may be each scaled to various sizes to be used for various products. The cushioning dimension is adjusted according to cushion stiffness need, enabling the shipper to tune the cushioning parameters for different engineering performance requirements without changing the visual design and customer experience. The right-sized baseboards for packaging may be prepared prior to assembly. For instance, equipment to create the packaging may receive or be adjusted based on information about a product to be shipped (e.g., dimensions, weight, barcode, etc.), assign a pre-loaded die line, and create a right-sized packaging for the product by cutting and creasing corrugated material in a dynamic way.

Some embodiments discussed herein provide a cushioning system not only providing packaging protection but also inhibiting theft or other tampering from occurring during shipping. Cushioning cells are formed in a rectangular prism around a rectangular product (e.g., a finished goods box containing a product) as surrounding walls, two of which facing each other include hypotenuses inside the prism-formed cells for inhibiting them from flattening, thereby helping to inhibit surreptitious access to the product, helping to secure it from theft during the shipping process, and providing enhanced support to protect the product from damage. The other two walls of the cushioning cells may not include hypotenuses but are further protected by the cover being securely attached thereto.

In some embodiments, the packaging may have a ripcord on the cover to enable a user to easily tear open the packaging with a low amount of force. After the ripcord is torn away, and as the cover is opening, respective cushioning walls without hypotenuses rotate out to open up a space in which a product is placed. Once the ripcord is removed, the cushions can rotate out to expand the space, freeing the product and providing space for the user to grab and remove the product from the packaging. The packaging is then simply recycled without further material separation.

Packaging described in this document achieves these and other beneficial characteristics by balancing structural robustness, eco-friendly materials, and aesthetic elements. A product contained by the packaging may be, for example, an electronic device such as, for example, a desktop, monitor, laptop, tablet computer, or smartphone, smart watch, or it may be a non-electronic device. As used herein, the term "product" may include retail finished goods packaging for the article that it contains.

In some embodiments, the packaging may be shipping packaging (e.g., packaging used for shipping a retail finished goods package containing and conveying a product to a user).

The packaging described herein provides a shipping packaging solution utilizing integrated cushioning systems that promotes ease of packaging and opening thereof. Integrated cushions formed by layering panels can provide robust protection of a product being shipped. The cushioning systems disclosed herein provide a retention effect that is flexible to accommodate a variety of sizes of a particular product or products.

These and other embodiments are discussed below with reference to the accompanying figures. However, those skilled in the art will readily appreciate that the detailed description given herein with respect to these figures is for explanatory purposes only and should not be construed as limiting the scope of the disclosure in any way.

FIG. 1 shows a product packaging 10 with a product 11 received therein. Product packaging 10 is shown in an open configuration, and includes integrated cushioning cells 20, 30, 40, and 50. Packaging 10 includes a base box 100 for storing product 11, and cushioning cells 20, 30, 40, and 50 are formed from folded portions of base box 100. In some embodiments, base box 100 is shaped as a rectangular cuboid and includes a product-receiving space 400 configured to receive product 11 on a base panel 300 of base box 100.

Figure 3:
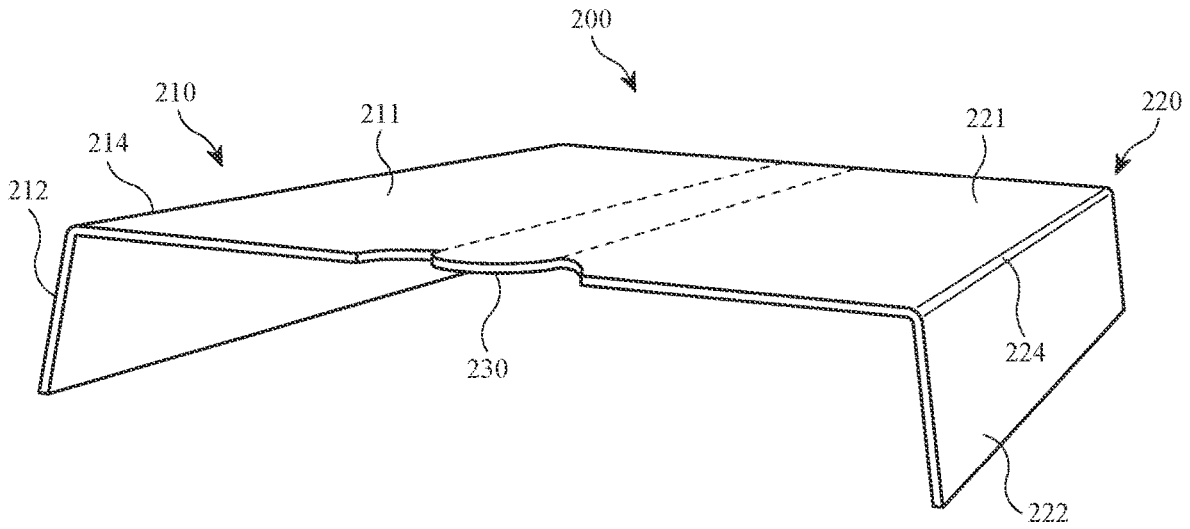
FIG. 3 shows a cover of the product packaging of FIG. 1.

Packaging 10 further includes a cover 200 to cover product 11 within product-receiving space 400 (see also FIG. 3). Base box 100 and cover 200 together form product packaging 10 to enclose product 11 therein. Cover 200 may be coupled to one or more of cushioning cells 20, 30, 40, and 50. In some embodiments, cover 200 includes a left cover panel 210 and a right cover panel 220 configured to be separated from each other when packaging 10 is in the open configuration as shown in FIG. 1. In some embodiments, left cover panel 210 and right cover panel 220 may be coupled to opposing ones of cushioning cells 20, 30, 40, and 50.

Figure 2:
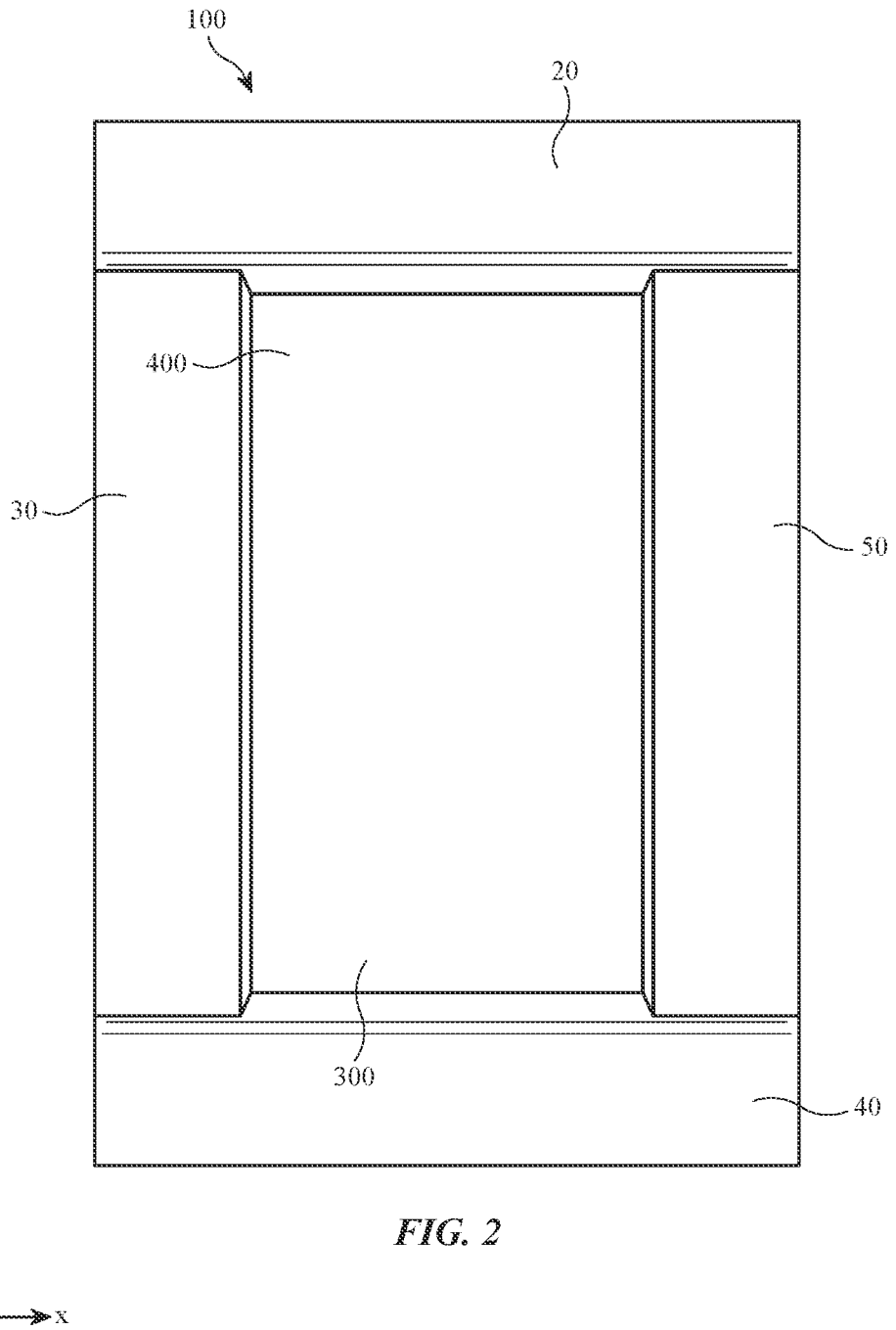
FIG. 2 shows a base box of the product packaging of FIG. 1 with a product-receiving space.

FIG. 2 shows base box 100 without a product. Referring to FIG. 2, base panel 300 and cushioning cells 20, 30, 40, and 50 form base box 100. Base panel 300 and cushioning cells 20, 30, 40, and 50 are integrally formed from a single blank. In some embodiments, cushioning cells 20, 30, 40, and 50 may include upper cushioning cell 20 at an upper edge of base panel 300, left side cushioning cell 30 disposed at a left side edge of base panel 300, lower cushioning cell 40 disposed at a lower edge of base panel 300, and right side cushioning cell 50 at a right side edge of base panel 300, respectively. In this configuration, cushioning cells 20, 30, 40, and 50 are arranged around a perimeter of base panel 300 and respectively define an upper side, a left side, a lower side, and a right side of base box 100. The terms "upper," "lower," "left," and "right" are used to help describe relative relationships in the context of the illustrated example.

As described above, cushioning cells 20, 30, 40, and 50 may be integrally formed from a continuous substrate, for example, panels integrally extending out from base panel 300 and folded in towards base panel 300, each forming a cuboid shape. In some embodiments, longitudinal lengths of upper and lower cushioning cells 20, 40 (i.e., in the x-direction of the axis of FIG. 2) may be the same as each other, and longitudinal lengths of left and right cushioning cells 30, 50 (i.e., in the y-direction of the axis of FIG. 2) may be the same as each other, such that base box 100 has a rectangular shape when viewing from the top as shown in FIG. 2. The shared length of upper and lower cushioning cells 20, 40 may be greater or smaller than the shared length of left and right cushioning cells 30, 50. Further, a height of each cushioning cell in a z-direction may vary. That is, the shape of base box 100 can be customized based on the size of a product so as to customize product-receiving space 400 to match dimensions of product 11.

Turning to FIG. 3, cover 200 is a single blank folded at left and right fold lines 214, 224 formed in left cover panel 210 and right cover panel 220. In some embodiments, left cover panel 210 and right cover panel 220 may be each folded down and coupled to left side cushioning cell 30 and right side cushioning cell 50, respectively. In some embodiments, left cover panel 210 may include a left front cover panel 211 and a left side cover panel 212. Left side cover panel 212 may be formed to the left of left fold line 214 by folding left cover panel 210 at left fold line 214. Left side cover panel 212 may be configured to be adhered to a left side of base box 100—more specifically to an outer left side of left cushioning cell 30. Right cover panel 220 may be configured similarly. It may include a right front cover panel 221 and a right side cover panel 222. Right side cover panel 222 may be formed to the right of right fold line 224 by folding right cover panel 220 at right fold line 224. Right side cover panel may be configured to be adhered to a right side of base box 100—more specifically to an outer right side of right cushioning cell 50. In some embodiments, cover 200 may further include a ripcord 230 having a grip portion 232 and extending in the center between left cover panel 210 and right cover panel 220. Ripcord 230 allows separation of left cover panel 210 and right cover panel 220 to thereby allow opening of packaging 10 while otherwise securing a product until packaging 10 is opened.

Figure 4:
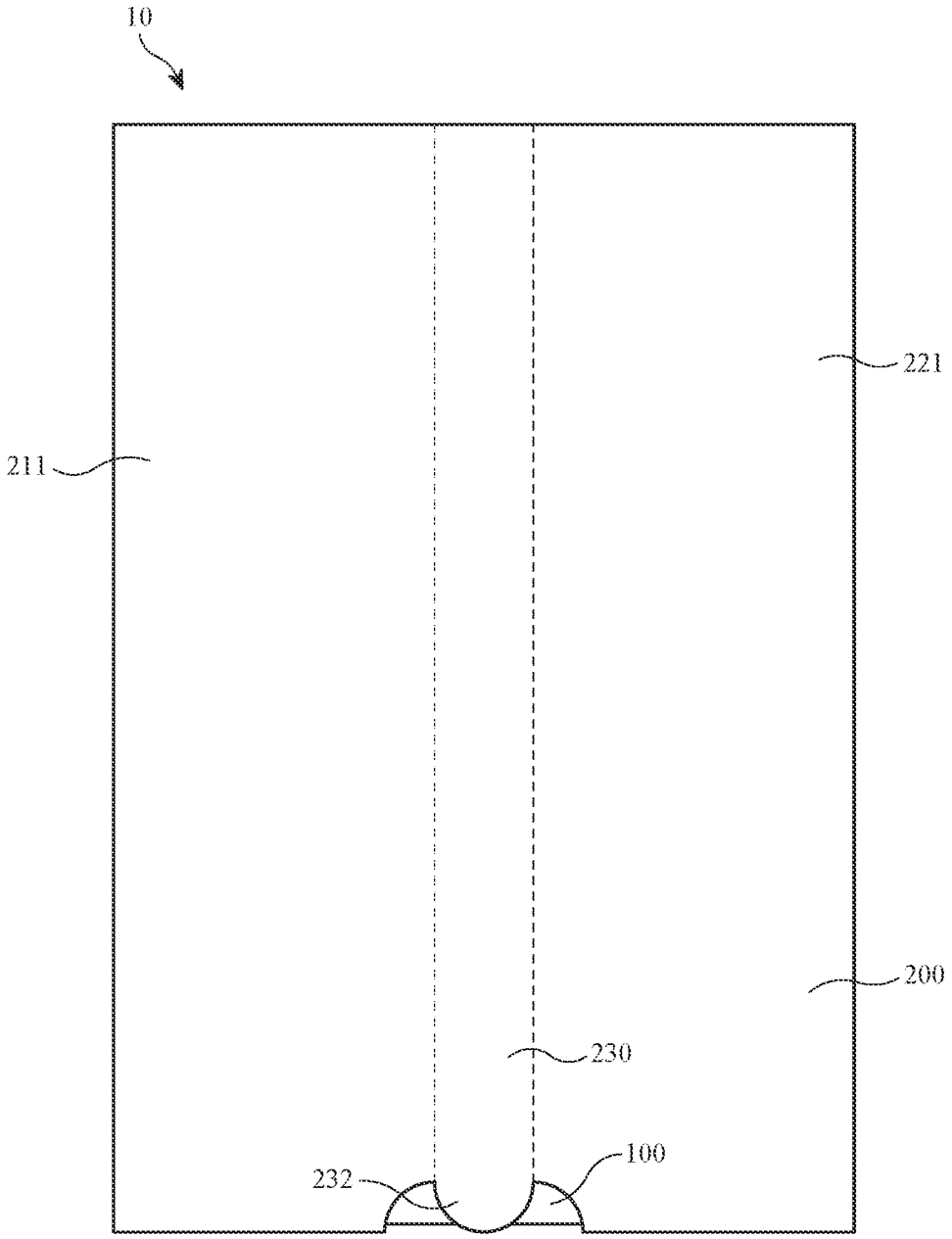
FIG. 4 shows the product packaging of FIG. 1 in a closed configuration.
Figure 5:
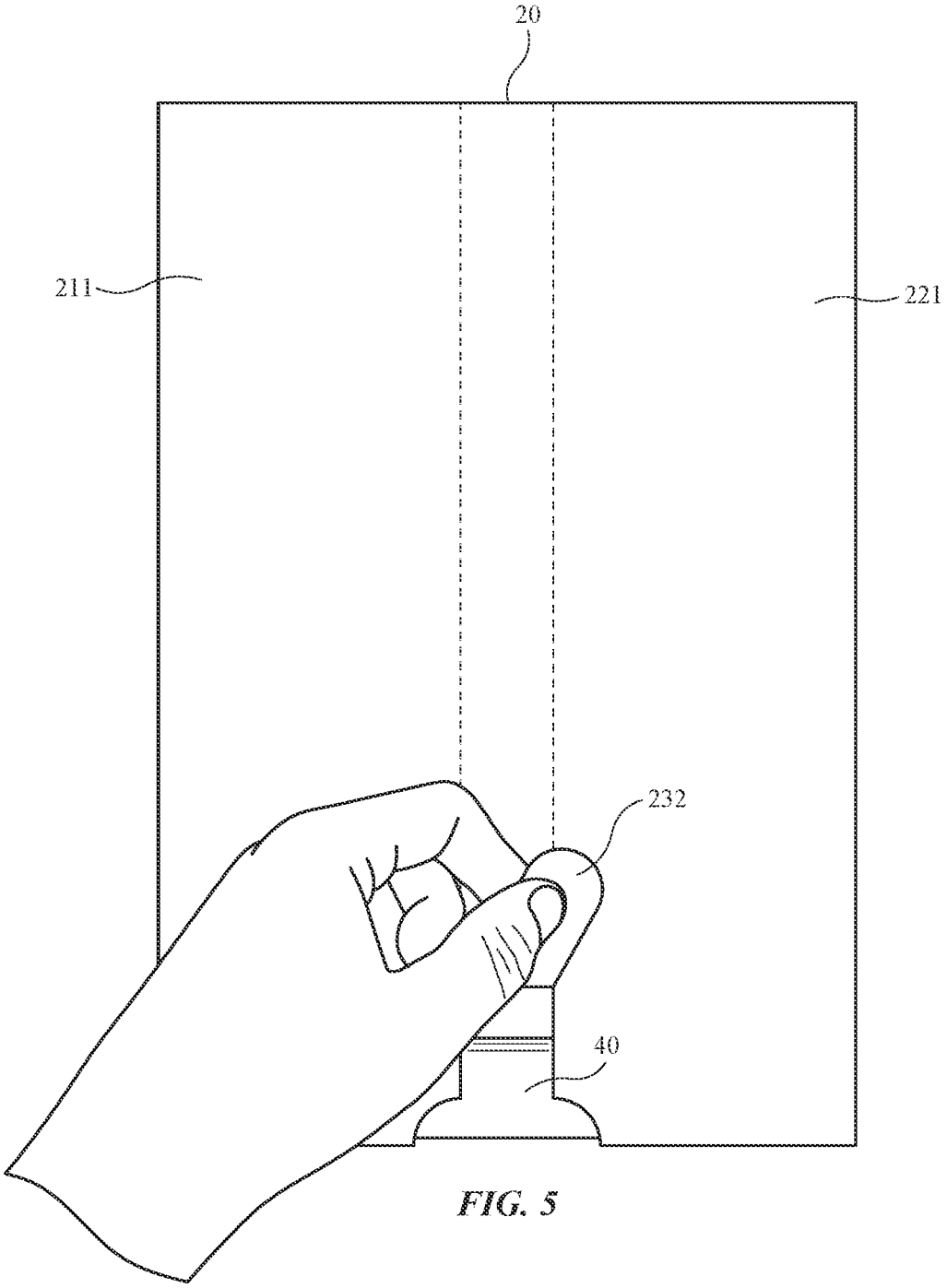
FIG. 5 shows the product packaging of FIG. 1 in an opening configuration with a ripcord partially tearing away.

Referring to FIG. 4, cover 200 covers base box 100 to form closed packaging 10. As shown, cover 200 includes ripcord 230 integrally formed between left cover panel 211 and right cover panel 221 for a user (e.g., customer or other end user) to manually tear away to open packaging 10. FIG. 5 illustrates product packaging 10 in an opening state by a user tearing away ripcord 230. The direction of ripcord 230 is not limited to as described in FIG. 5, such that ripcord 230 may have grip portion 232 at the other end of ripcord 230, or at both ends. When ripcord 230 is in a state of tearing away by a manual pulling force, left cover panel 210 and right cover panel 220 are separated from each other, allowing each to be separately lifted at their inner edges (edges created by the removal of ripcord 230) while left side cover panel 212 and right side cover panel 222 remain secured to left and right sides, respectively, of base box 100.

Figure 6:
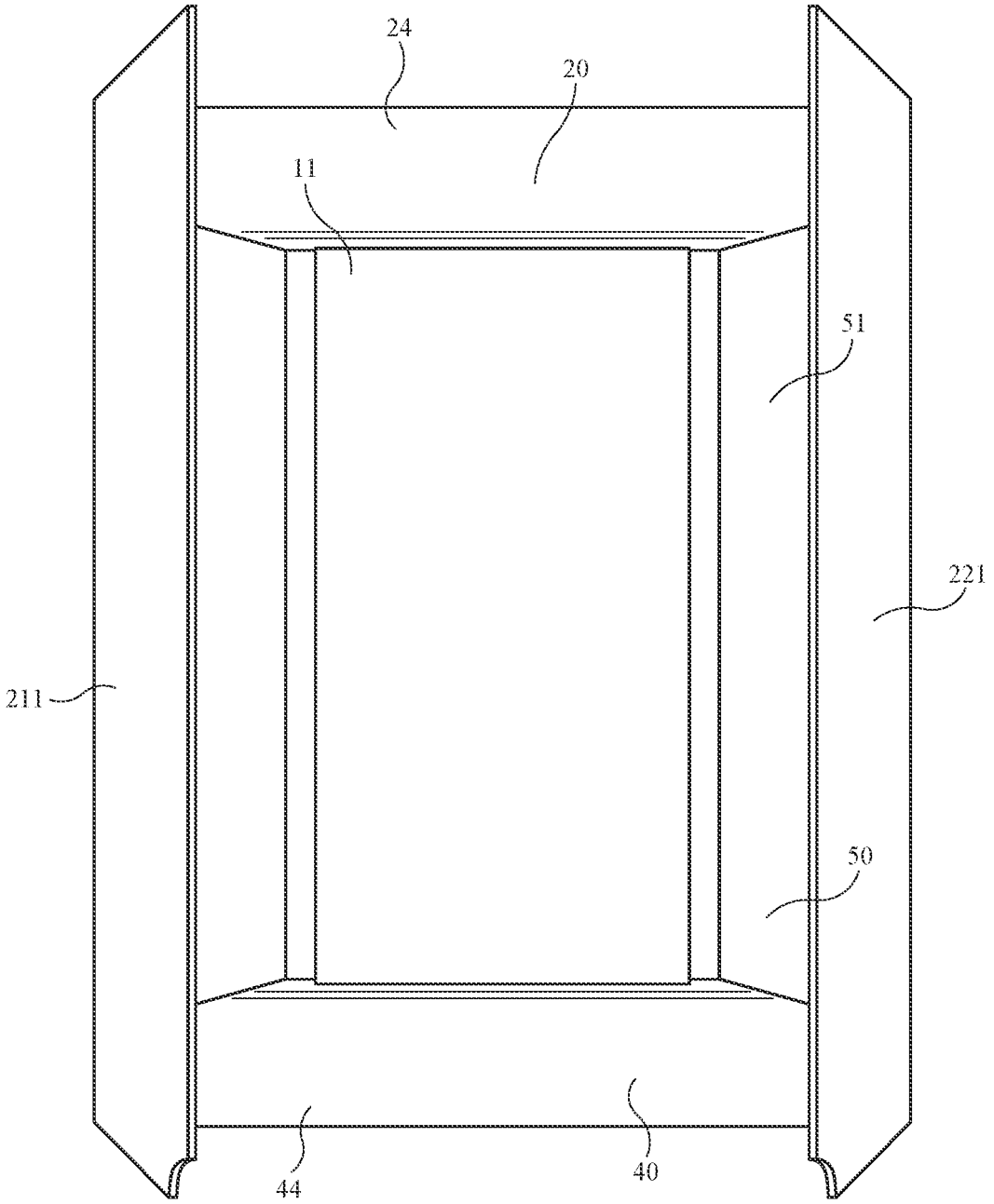
FIG. 6 shows the product packaging of FIG. 1 with left and right cushioning cells rotating as the packaging is opened.

FIG. 6 shows packaging 10 in an open state as ripcord 230 is completely removed.

Cover 200 is entirely separated into left cover panel 211 and right cover panel 221, exposing product 11 inside packaging 10. A user can then rotate left cover panel 211 and right cover panel 221 further out to the left and to the right, respectively, to completely open up packaging 10. As left cover panel 211 and right cover panel 221 rotate out, respective left cushioning cell 30 and right cushioning cell 50 rotate together with left cover panel 211 and right cover panel 221 in the same motion. More specifically, left side and right side of left cover panel 211 and right cover panel 221, respectively, to which left cover panel 211 and right cover panel 221 are respectively attached, rotate together as a user is opening up packaging 10. That is, as in the example shown in FIG. 8 (in which cover 200 is omitted for clarity), when cover 200 is separated by removing ripcord 230, left cushioning cell 30 and right cushioning cell 50 rotate away from base panel 300 as a user manually rotates out left cover panel 211 and right cover panel 221, while upper cushioning cell 20 and lower cushioning cell 40 remain intact and secured to base panel 300.

Figure 7:
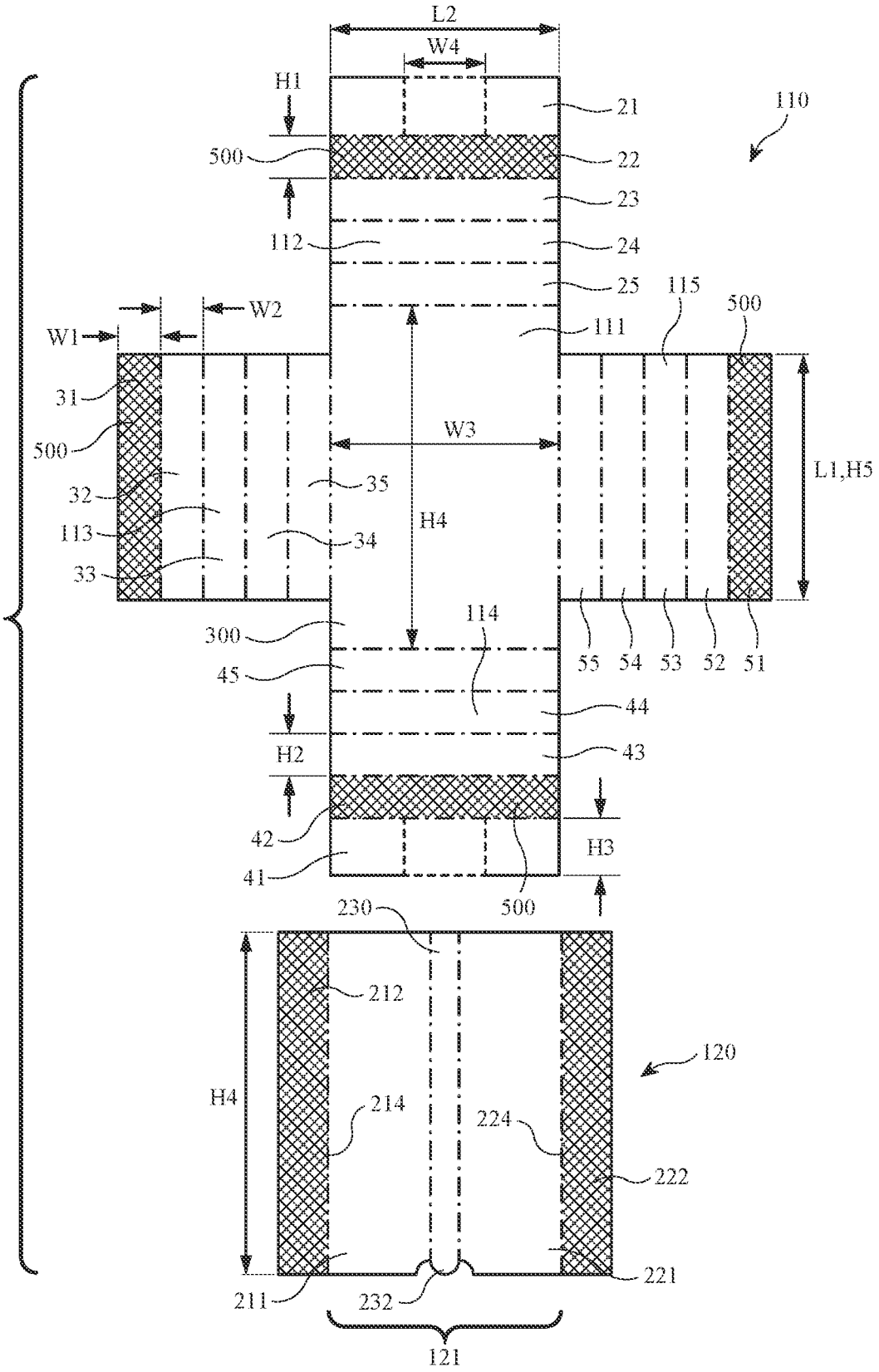
FIG. 7 shows a blank for forming of the product packaging of FIG. 1.

Turning to FIG. 7 which illustrates a layout of unassembled product packaging 10, product packaging 10 is formed from two separate blanks, a first blank 110 for forming base box 100 and a second blank 120 for forming cover 200. In some embodiments, first blank 110 may be prepared by cutting a single blank to form the shape (e.g., cross shape) as illustrated. In FIG. 7, the solid outer lines define edges of their respective blanks (e.g., where the blank was cut from a larger sheet). And the dot-dash broken lines define fold lines, which may in some embodiments be pre-creased or partially cut (e.g., using a miter cut or kiss cut that does not go all the way through the material), along which blank is folded to form its respective packaging component, base box 100 or cover 200.

In some embodiments, first blank 110 may include a central base panel 111 and four side panels: a left panel 113, a right panel 115, an upper panel 112, and a lower panel 114 each extending out from central base panel 111 from a left side, a right side, an upper side, and a lower side, respectively, of central base panel 111. Each side panel is integrally connected to central base panel 111 at an upward fold line.

In some embodiments, each of left panel 113 and right panel 115 may be divided into five sub-panels. For instance, left panel 113 includes sub-panels 31, 32, 33, 34, 35 each integrally connected to each other at upward fold lines, and right panel 115 includes sub-panels 51, 52, 53, 54, 55 each integrally connected to each other at upward fold lines. The sub-panels of left panel 113 and right panel 115 can be folded inwardly to form respective cushioning cells (i.e., cushioning cells 30 and 50 forming a cuboid shape having a rectangular cross-section). In some embodiments, the outermost sub-panel of each of left panel 113 and right panel 115 may be provided with an adhesive. For example, sub-panel 31 of left panel 113 and sub-panel 51 of right panel 115 each has an adhesive on respective outer surfaces (the underside of blank 110 as it is shown in FIG. 7). In this way, when left panel 113 is folded 90 degrees at each of its fold lines, sub-panel 31 will overlap and adhere to sub-panel 35, thereby forming cushioning cell 30. Similarly, when right panel 115 is folded 90 degrees at each of its fold lines, sub-panel 51 will overlap and adhere to sub-panel 55, thereby forming cushioning cell 50. Notably, neither cushioning cell 30 nor cushioning cell 50 is adhered to central base panel 111, thereby allowing them to rotate about their respective innermost fold lines, as described above (i.e., no sub-panel of left panel 113 or right panel 115 is adhered to central base panel 111). Once folded and attached, left panel 113 and right panel 115 form left cushioning cell 30 and right cushioning cell 50, respectively, as shown in FIG. 2, and each sub-panel defines walls of its respective cushioning cell.

In some embodiments, sub-panels 31, 33, 35 of left panel 113 and sub-panels 51, 53, 55 of right panel 115 may have the same width W1, and sub-panels 32, 34 of left panel 113 and sub-panels 52, 54 of right panel 115 may have the same width W2. In some embodiments, all of sub-panels of left panel 113 and right panel 115 may have the same width, that is, W1=W2, and in this case, left cushioning cell 30 and right cushioning cell 50 have a square cross-sectional shape. Alternatively, in some embodiments, W1 may be different from W2, in which left cushioning cell 30 and right cushioning cell 50 have a non-square rectangular cross-sectional shape.

Similarly, each of upper panel 112 and lower panel 114 comprises five sub-panels integrally connected at parallel upward fold lines. For example, upper panel 112 includes sub-panels 21, 22, 23, 24, 25, and lower panel 113 includes sub-panels 41, 42, 43, 44, 45. The sub-panels of upper panel 112 and lower panel 114 can be folded inwardly to form respective cushioning cells (i.e., cushioning cells 20 and 40 forming a cuboid shape having a rectangular cross-section). In some embodiments, sub-panels 22 and 42 (the second-from-outermost sub-panels of their respective panels) may be provided with an adhesive on their respective outer surfaces (the underside of blank 110 as it is shown in FIG. 7). In this way, when upper panel 112 is folded at each of its fold lines, sub-panel 22 will overlap with a portion of central base panel 111, thereby forming cushioning cell 20 fixed by adhesive to central base panel 111. Similarly, when lower panel 114 is folded at each of its fold lines, sub-panel 42 will overlap with a portion of central base panel 111, thereby forming cushioning cell 40 fixed by adhesive to central base panel 111.

To increase structural stability of cushioning cells 20 and 40, their outermost sub-panels (sub-panels 21 and 41, also referred to as hypotenuse panels) may have the greatest height of their sub-panels, and each may form a hypotenuse in its respective cushioning cell. To effect this configuration, each of outermost sub-panels 21 and 41 may be folded 135 degrees relative to its adjacent sub-panel, while the remaining folds between sub-panels may be at 90 degrees.

Accordingly, when folded, sub-panels 22 and 42 can be securely attached to an inner side of central base panel 111 only to portions on central base panel 111 (portions adjacent to sub-panels 25 and 45, respectively) by adhesives. Once folded and attached, upper panel 112 and lower panel 114 form upper cushioning cell 20 and lower cushioning cell 40, respectively, as shown in FIG. 2, where sub-panels 22, 23, 24, 25 and sub-panels 42, 43, 44, 45 define walls of their respective cushioning cells, and where sub-panels 21 and 41 define hypotenuses of their respective cushioning cells.

In some embodiments, sub-panels 22 and 24 of upper panel 112 and sub-panels 42 and 44 of lower panel 114 may have the same height H1, and sub-panels 23 and 25 of upper panel 112 and sub-panels 43 and 45 of lower panel 114 may have the same height H2. In some embodiments, heights H1 and H2 may be the same or different from each other. In addition, sub-panels 21 and 41, which are the endmost sub-panels, may have a height H3 greater than other sub-panels of upper panel 112 and lower panel 114, that is, height H3 is greater than heights H1 and H2. More specifically, the square of height H3 may be equal to the sum of the squares of heights H1 and H2, to thereby serve as a supporting hypotenuse when formed into its respective cushioning cell, as described in more detail elsewhere herein. Accordingly, when sub-panels of upper panel 112 and sub-panels of lower panel 114 are folded to form cushioning cells, sub-panels 21 and 41 are positioned diagonally inside respective cushioning cells as shown in FIG. 10. In some embodiments, a width W3 of each of sub-panel 21 of upper panel 112 and sub-panel 41 of lower panel 114 may be equal to or smaller than the other panels of upper panel 112 and lower panel 114. For example, alternative sub-panels 21 and 41 having a reduced width W4 are shown in phantom lines. That is, the dimension of sub-panel 21 and sub-panel 41 forming hypotenuse panels of upper and lower cushioning cells 20, 40 is adjustable to provide more or less stiffness to packaging 10. Further, by making the widths of sub-panels 21 and 41 less than that of the other sub-panels of panels 112 and 114, sub-panels 21 and 41 are less visible at the ends of their respective cushioning cells (e.g., their edges are recessed within their respective cushioning cells, and so would not be visible as they are in FIG. 9).

Figure 9:
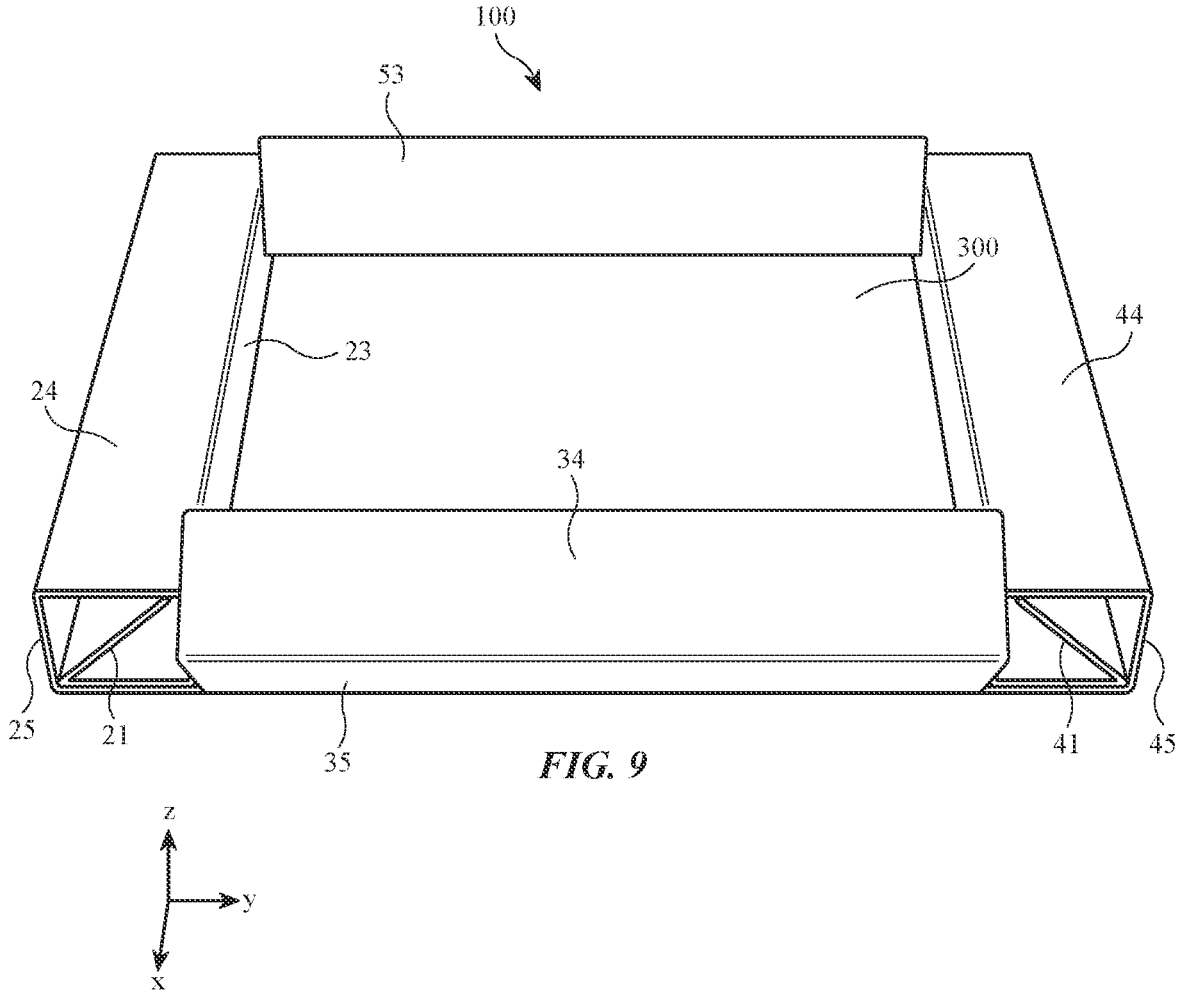
FIG. 9 shows a perspective view of the partially opened base box of the product packaging of FIG. 1.
Figure 10:
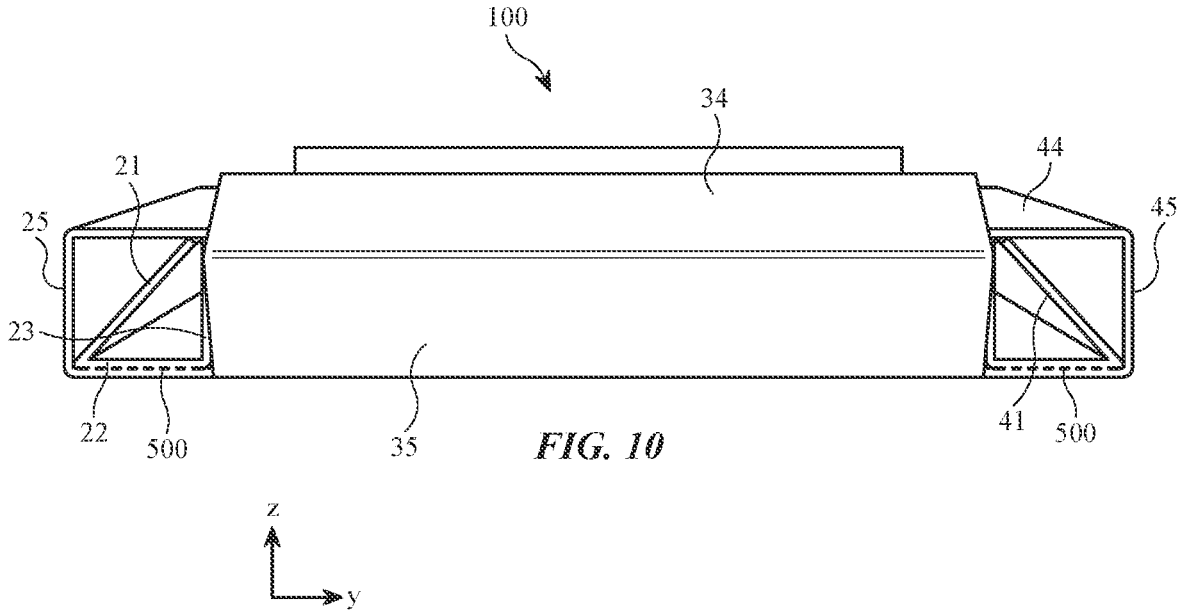
FIG. 10 shows a side view of the partially opened base box of the product packaging of FIG. 1.

Referring to FIG. 9, the hypotenuses formed inside upper and lower cushioning cells 20, 40 rigidly support respective cushioning cells from flattening or being damaged. When an external impact is applied to upper and lower cushioning cell 20, 40, the respective hypotenuses may provide additional support to provide increased cushioning. The hypotenuses formed within cushioning cells 20, 40 also help prevent surreptitious theft of product 11 from within packaging 10. By providing diagonal bracing, they help cushioning cells 20, 40 maintain their shape (e.g., their rectangular cuboid shape, with their square or rectangular cross section), thereby helping prevent cushioning cells 20, 40 from being flattened to gain access to product-receiving space 400 without opening cover 200. In contrast to left and right cushioning cells 30, 50, upper and lower cushioning cells 20, 40 are not layered by left side cover panel 212 and right side cover panel 222. With the hypotenuses, however, all of cushioning cells surrounding a product inside packaging 10 can securely protect the product until a user tears away ripcord 230.

As described herein, each of left panel 113, right panel 115, upper panel 112, and lower panel 114 is configured to be folded to form a cushioning cell disposed around a perimeter of central base panel 111, thereby forming base box 100. In addition, certain dimensions of each of left panel 113, right panel 115, upper panel 112 may vary based on the product size and weight (e.g., cushioning considerations). For instance, a small product box containing a portable mobile device is suitable for a smaller packaging, and may not benefit from as much cushioning as would a larger, heavier product such as a tablet computer or a laptop.

For instance, certain dimensions of first blank 110 (and resulting base box 100) are determined by matching the shape of the product (i.e., the finished goods box containing a product) to be packaged therein. A length L1 of each of panels 113 and 115 match a height of the product box. Width W2 of each of sub-panels 33, 35 and 53, 55 match the depth of the product box. Height H2 of each of sub-panels 23, 25 and 43, 45 also match the depth of the product box. Widths and heights of sub-panels 32, 34, 52, 54, 22, 24, 42, 44 are not based on the product box dimensions, but on the degree of cushioning desired, which may be affected by the product box weight or expected shipping conditions. Greater dimensions for these panels equate to greater cushioning. Finally, a length L2 (or W3) of each of panels 112 and 114 are the width of the product box plus the width of left and right cushioning cells 30, 50 (i.e., the widths of sub-panels 32, 34 and 52, 52. In this way, upper and lower cushioning cells 20, 40 will cover the ends of left and right cushioning cells 30, 50.

Packaging 10 is completed with cover 200 which is formed by second blank 120. In some embodiments, second blank 120 includes a central cover panel 121 having the same width W3 and height H4 as central base panel 111. Central cover panel 121 integrally expends outward from a left side thereof to form left side cover panel 212, where central cover panel 121 and left side cover panel 212 are connected at a downward fold line 214. Central cover panel 121 further integrally expends outward from a right side thereof to form a right side cover panel 222, where central cover panel 121 and right side cover panel 222 are connected at a downward fold line 224. Left side cover panel 212 and right side cover panel 222 each has the same width as width W1 of sub-panels 31, 33, 35 of left panel 113 and sub-panels 51, 53, 55 of right panel 115. Each of left side cover panel 212 and right side cover panel 222 has an adhesive disposed on its inner surface (the underside of blank 120 as it is shown in FIG. 7) such that left side cover panel 212 and right side cover panel 222 can be attached to a respective outer side of left cushioning cell 30 and right cushioning cell 50. More specifically, left side cover panel 212 and right side cover panel 222 are respectively attached to sub-panel 35 of left panel 113 and sub-panel 55 of right panel 115 when forming base box 100.

As described herein, second blank 120 forming cover 200 has height H4 that corresponds to height of central base panel 111. And, left and right panels 113, 115 have height H5 (or length L1) smaller than height H4 of second blank 120. By this way, when second blank 120 is folded to form cover 200, it can cover open ends of upper and lower cushioning cells 30, 50. That is, the exposed end portions of upper and lower cushioning cells 30, 50 shown in FIG. 10 are covered and protected by cover 200 when base box 100 and cover 200 are assembled (see also FIGS. 2 and 4).

In some embodiments, central cover panel 121 may further include a ripcord 230 extending vertically along its entire height and disposed centrally along the width of central cover panel 121. Various types of tear-away mechanism can be adapted as ripcord 230, for example, a perforation pattern cut through a cardboard, score lines, a line of serrations or weakened material, or other modes of separating portions of paperboard known in the art. Each panel of second blank 120 is integrally connected as a single blank and forms cover 200. Ripcord 230 provides a tamper-evident function. In some embodiments, ripcord 230 includes a grip portion 232 configured to be gripped by a user to tear away ripcord 230 through a breakable joint or breakable joints along central cover panel 121 between left front cover panel 211 and left side cover panel 212.

A user can fold and adhere first blank 110 at fold lines having the above-described configuration to form base box 100 of FIG. 2 and place an item in the space formed by cushioning cells 20, 30, 40, 50 and base panel 300 (i.e., product-receiving space 400). The user can then place cover 200 (formed from second blank 120) on top of base box 100, and attach left side cover panel 212 and right side cover panel 222 at respective sides of base box 100 to seal packaging 10. As described herein, when a user (e.g., customer or other end user) receives packaging 10 scaled, the user can open packaging 10 by tearing away ripcord 230.

Figure 8:
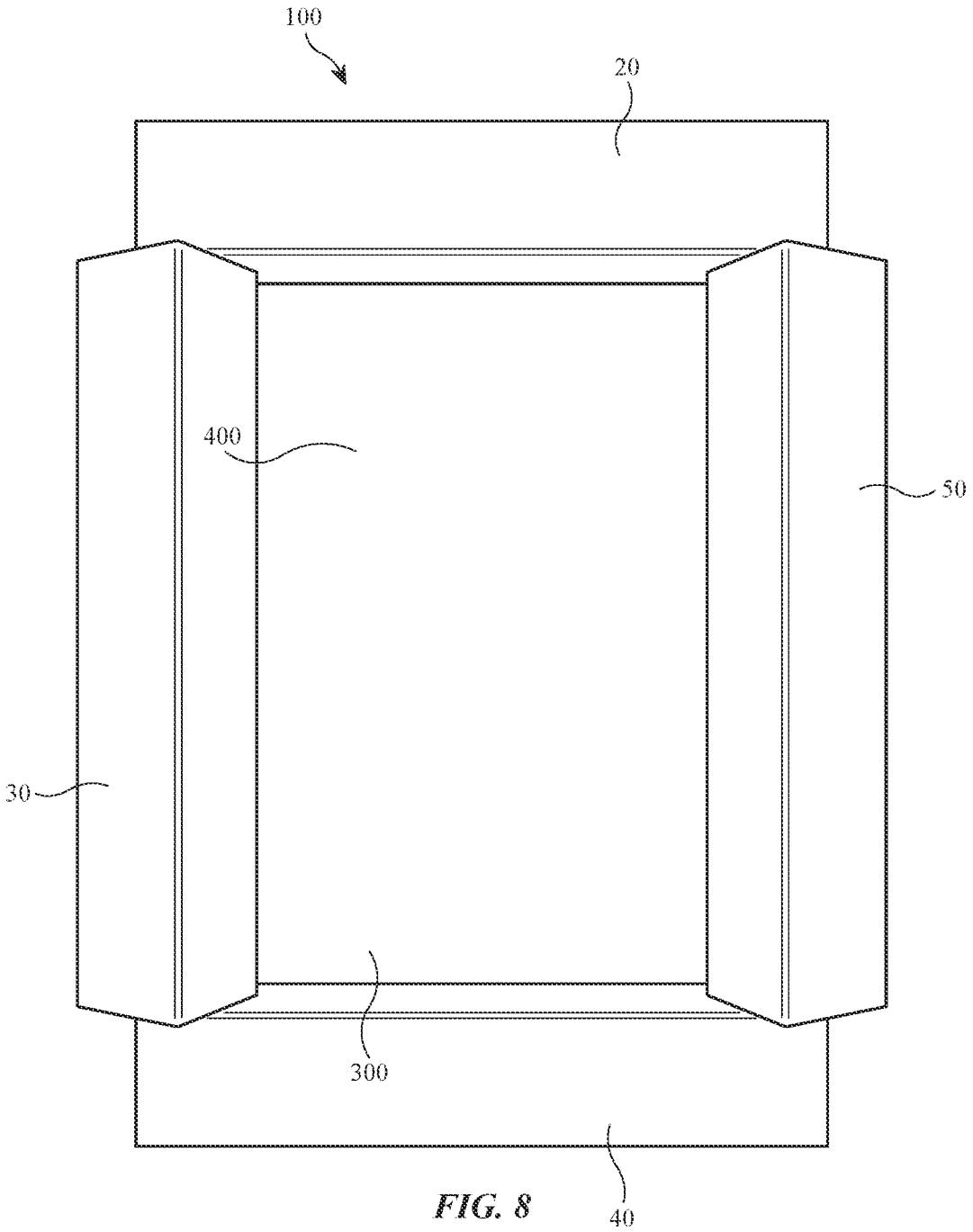
FIG. 8 shows a top view of a partially opened base box of the product packaging of FIG. 1.

Referring back to FIG. 5, to open packaging 10, a user grasps and tears away grip portion 232 of ripcord 230 by lifting up which separates cover 200 into left cover panel 211 and right cover panel 221. Left cover panel 211 and right cover panel 221 become completely separated from each other once ripcord 230 is removed, as shown in FIG. 6. In addition, as left cover panel 211 and right cover panel 221 are being separated and rotated outward, left side cushioning cell 30 and right side cushioning cell 50 rotate together with left cover panel 211 and right cover panel 221, respectively, relative to base panel 300 (i.e., central base panel 111) to expose and expand product-receiving space 400. FIGS. 8 and 9 are referenced to describe the rotating motion of left side cushioning cell 30 and right side cushioning cell 50. In FIGS. 8 and 9 cover 200 is omitted for clarity. As described above, sub-panels of left side panel 113 form left side cushioning cell 30 and sub-panels of right side panel 115 form right side cushioning cell 50, and are folded in without being adhered to base panel 300. Therefore, left side cushioning cell 30 and right side cushioning cell 50 can rotate (e.g., 90 degrees) with the respective cover panel. Here, outer surfaces of sub-panel 35 and sub-panel 55, forming outer walls of base box 100, are respectively attached to left side cover panel 212 and right side cover panel 222, which allows rotation thereof when opening out left cover panel 211 and right cover panel 221.

Turning back to FIG. 1, which shows packaging 10 having product 11 therein in a completed open state, left side cushioning cell 30 and right side cushioning cell 50 have rotated out about 90 degrees, which expands product-receiving space 400 by moving cushioning cells 30 and 50 away from product 11. A user can thus easily access product 11 via the new spaces beside it and remove it from packaging 10. In addition, hypotenuses formed inside respective cushioning cells can prevent cushioning cells from flattening, helping to ensure that product 11 is secure from tampering or theft during the shipping process, while ripcord provides a tamper-evident function. As shown in FIG. 9, upper and lower cushioning cells 20, 40 remain rigid as the packaging opens due to respective interior hypotenuses.

As discussed herein, components of the packaging described may be formed from one or more blanks, e.g., cardboard or paper blanks. In some embodiments, the blank is formed of a single continuous substrate, such as, for example cellulose-based material like cardboard corrugate. Other cellulose-based materials are contemplated, such as paperboard, certain molded fiber components of sufficient construction, or grayboard.

Each of the components may be composed of recyclable materials including the shipping packaging, finished packaging, seals, and other related components. Thus, if and when the customer opts to dispose of the packaging, the packaging may simply be recycled without requiring material separation (e.g., in a single-stream recycling program).

Each of the components and their constituent parts, and other variations described herein may include corresponding features described with reference to each of the other components and features described without limitation.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material (e.g., a sheet of cardboard corrugate, or roll of material), or other fiber or cellulose based material. Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. Product packaging, comprising:

a base box comprising:

a base panel; and cushioning cells comprising:

an upper cushioning cell disposed at an upper edge of the base panel and defining an upper side of the base box;

a lower cushioning cell disposed at a lower edge of the base panel and defining a lower side of the base box;

a left side cushioning cell disposed at a left side edge of the base panel and defining a left side of the base box; and a right side cushioning cell disposed at a right side edge of the base panel and defining a right side of the base box;

wherein the left side cushioning cell and the right side cushioning cell are hingedly coupled to the base panel, wherein each of the cushioning cells comprises four panels arranged to form a rectangular cross-section, wherein each of the left side cushioning cell and the right side cushioning cell further comprises a fifth panel, the fifth panel being adhered to one of the four panels, wherein none of the panels of the left side cushioning cell or the right side cushioning cell are adhered to the base panel, wherein the base panel and the cushioning cells together define a product-receiving space, and wherein the base panel and the cushioning cells are integral and formed from a single blank; and a cover configured to cover the product-receiving space of the base box, the cover configured to be coupled to the left side cushioning cell and to the right side cushioning cell.

2. The product packaging of claim 1, wherein when the cover is intact and is coupled to the left side cushioning cell and the right side cushioning cell, the cover stops the left side cushioning cell and the right side cushioning cell from rotating relative to the base panel, and maintains the product packaging in a closed configuration.

3. The product packaging of claim 2, wherein the cover is configured to be separated into a left cover panel coupled to the left side cushioning cell and a right cover panel coupled to the right side cushioning cell such that separating the cover into the left cover panel and the right cover panel transitions the packaging into an open configuration in which the left side cushioning cell and the right side cushioning cell rotate together with the left cover panel and the right cover panel, respectively, relative to the base panel to expose and expand the product-receiving space.

4. The product packaging of claim 3, wherein the cover comprises a ripcord extending between the left cover panel and the right cover panel, wherein the left cover panel, the right cover panel, and the ripcord are integral and formed from a single blank, and wherein tearing away the ripcord separates the left cover panel and the right cover panel, thereby allowing the left cover panel and the right cover panel to be rotated away from each other, exposing the product-receiving space.

5. The product packaging of claim 4, wherein the left cover panel comprises a left front cover panel and a left side cover panel, and wherein the left side cover panel is adhered to an outer side of the left side cushioning cell, wherein the right cover panel comprises a right front cover panel and a right side cover panel, and wherein the right side cover panel is adhered to an outer side of the right-side cushioning cell, and wherein, when the left cover panel and the right cover panel are separated and rotated away from each other, the left side cover panel and the right side cover panel rotate together with the left side cushioning cell and the right side cushioning cell, respectively, to expand the product-receiving space.

6. Product packaging, comprising:

a base box comprising:

a base panel; and cushioning cells comprising:

an upper cushioning cell disposed at an upper edge of the base panel and defining an upper side of the base box;

a lower cushioning cell disposed at a lower edge of the base panel and defining a lower side of the base box;

a left side cushioning cell disposed at a left side edge of the base panel and defining a left side of the base box; and a right side cushioning cell disposed at a right side edge of the base panel and defining a right side of the base box;

wherein the left side cushioning cell and the right side cushioning cell are hingedly coupled to the base panel, wherein each of the cushioning cells comprises four panels arranged to form a rectangular cross-section, wherein each of the upper cushioning cell and the lower cushioning cell comprises a fifth panel, the fifth panel forming a hypotenuse panel extending diagonally between interior corners of its respective cushioning cell, wherein the base panel and the cushioning cells together define a product-receiving space, and wherein the base panel and the cushioning cells are integral and formed from a single blank; and a cover configured to cover the product-receiving space of the base box, the cover configured to be coupled to the left side cushioning cell and to the right side cushioning cell.

7. The product packaging of claim 6, wherein each of the left side cushioning cell and the right side cushioning cell further comprises a fifth panel, the fifth panel being adhered to one of the four panels, wherein none of the panels of the left side cushioning cell or the right side cushioning cell are adhered to the base panel.

8. The product packaging of claim 6, wherein the hypotenuse panels extend upwardly toward the product-receiving space.

9. The product packaging of claim 6, wherein each hypotenuse panel has a length less than those of the other four panels of its respective cushioning cell.

10. The product packaging of claim 9, wherein an adhesive is disposed on an outer side of a panel adjacent to the hypotenuse panel of the panels of each of the upper and lower cushioning cells, adhering its respective cushioning cell to the base panel.

11. The product packaging of claim 1, wherein the base box is integrally formed of a unitary cardboard material, and wherein the cover is integrally formed of a unitary cardboard material.

12. A packaged product assembly, comprising:

the product packaging of claim 1; and a product disposed within the product-receiving space, wherein the product packaging is in a closed configuration in which the product is restrained from moving relative to the product packaging by contact with the base panel, the cushioning cells, and the cover.

13. The packaged product assembly of claim 12, wherein the product is a packaged product including retail packaging having an outer shape of a rectangular cuboid, wherein the base panel, the cushioning cells, and the cover together define the product-receiving space as a rectangular cuboid matching that of the outer shape of the retail packaging.

14. A blank for forming product packaging comprising:

a central base panel;

a left panel integrally extending outward from a left side of the central base panel and connected to the central base panel at an upward fold line;

a right panel integrally extending outward from a right side of the central base panel and connected to the central base panel at an upward fold line;

an upper panel integrally extending outward from an upper side of the central base panel and connected to the central base panel at an upward fold line; and a lower panel integrally extending outward from a lower side of the central base panel and connected to the central base panel at an upward fold line, wherein each of the left panel and the right panel comprises five sub-panels connected at parallel upward fold lines, and wherein, counting outward from the central base panel, their first and third sub-panels all have the same width, and their second and fourth sub-panels all have the same width, wherein each of the upper panel and the lower panel comprises five sub-panels connected at parallel upward fold lines, and wherein, counting outward from the central base panel, their first and third sub-panels all have the same height, their second and fourth sub-panels all have the same height and their fifth sub-panels both have a height equal to a hypotenuse height, where the square of the hypotenuse height equals the sum of the squares of the heights of the third sub-panels and the fourth sub-panels.

15. The blank of claim 14, wherein each of the left panel, the right panel, the upper panel, and the lower panel is configured to be folded to form a cushioning cell disposed around a perimeter of the central base panel, thereby forming a base box.

16. A blank system, comprising:

the blank of claim 14, wherein the blank is a base box blank; and a cover blank comprising a central cover panel, wherein the central cover panel has a width equal to a width of the central base panel, and wherein the central cover panel comprises a ripcord extending vertically along its entire height, the ripcord disposed centrally along the width of the central cover panel.

17. The blank system of claim 16, wherein the cover blank further comprises:

a left side panel integrally extending outward from a left side of the central cover panel and connected to the central cover panel at a downward fold line; and a right side panel integrally extending outward from a right side of the central cover panel and connected to the central cover panel at a downward fold line, wherein the left side panel and the right side panel each have the same width as the width of the first sub-panels of the left panel and the right panel the base box blank.

18. The blank system of claim 17, wherein each of the left side panel and the right side panel has an adhesive disposed on one side, and at least one sub-panel of each of the right, left, upper, and lower panels has an adhesive disposed on one side.

19. The blank system of claim 17, wherein when the base box blank is folded to form a base box and the cover blank is folded to form a cover, the base box blank and the cover blank together form a packaging to enclose a product therein.

* * * * *